US006200026B1

(12) United States Patent
Carmichael

(10) Patent No.: US 6,200,026 B1
(45) Date of Patent: Mar. 13, 2001

(54) INFLATABLE DIVE MARKER AND COLLECTION BAG

(76) Inventor: Robert M. Carmichael, 2124 NE. 24th St., Wilson Manors, FL (US) 33305

( * ) Notice: Subject to any disclaimer, the term of this patent is extended or adjusted under 35 U.S.C. 154(b) by 0 days.

(21) Appl. No.: 09/049,648

(22) Filed: Mar. 27, 1998

Related U.S. Application Data

(60) Provisional application No. 60/042,201, filed on Mar. 31, 1997.

(51) Int. Cl.[7] ..... B65D 33/00

(52) U.S. Cl. ..... 383/3; 383/16; 383/67; 383/97

(58) Field of Search ..... 383/3, 67, 117, 383/16, 43, 97

(56) References Cited

U.S. PATENT DOCUMENTS

| | | | | |
|---|---|---|---|---|
| D. 362,817 | * | 10/1995 | Fryburg | D10/104 |
| 2,028,309 | * | 1/1936 | Adams | 383/67 X |
| 2,241,314 | * | 5/1941 | Mohler | 383/3 X |
| 3,777,498 | * | 12/1973 | Andrews et al. | 383/3 X |
| 4,765,381 | * | 8/1988 | Castle | 383/67 X |
| 4,790,463 | * | 12/1988 | Hansen | 383/3 X |
| 4,905,404 | * | 3/1990 | Pasion et al. | 43/55 |
| 4,960,399 | * | 10/1990 | Lyon | 383/117 X |
| 4,979,451 | * | 12/1990 | Serle | 114/54 |
| 5,011,334 | * | 4/1991 | Vorhauer | 405/186 |
| 5,012,964 | * | 5/1991 | Falletta et al. | 224/153 |
| 5,288,150 | * | 2/1994 | Bearman | 383/67 X |
| 5,687,840 | * | 11/1997 | Sherman | 383/67 X |
| 5,735,719 | * | 4/1998 | Berg | 441/11 |
| 5,755,172 | * | 5/1998 | Fryburg | 114/52 |
| 5,839,931 | * | 11/1998 | Shieh | 441/6 |

* cited by examiner

*Primary Examiner*—Jes F. Pascua
(74) *Attorney, Agent, or Firm*—Malin, Haley & DiMaggio, P.A.

(57) ABSTRACT

An inflatable diver marker and collection bag is disclosed which can be utilized by a diver for collecting lobster, conch, etc., as well as providing for a diver location marker to boats and other water vehicles traveling in the vicinity of the diver. The dive marker/collection bag also provides for an individual ascent line for the diver. The inflatable dive marker/collection bag allows the diver to send the collected items to the surface without the diver having to surface. In one embodiment, the shape of at least the bottom half of the collection bag is "bell" shaped to help prevent the collected items from escaping when additional items to the collection bag.

11 Claims, 1 Drawing Sheet

INFLATABLE DIVE MARKER AND COLLECTION BAG

This application claims the benefit of U.S. Provisional Application No. 60/042,201 filing Mar. 31, 1997.

BACKGROUND OF THE INVENTION

1. Field of the Invention

The present invention relates generally to diving and more particular to an inflatable diver marker and collection bag to be utilized by a diver for the collection of lobster, conch, etc., as well as providing for a diver location marker to boats and other water vehicles traveling in the vicinity of the diver.

2. Description of the Prior Art

Many divers carry a collection bag for game, treasure or even trash collecting. One conventional bag is a simple mesh construction having an opening at the top and provided with a conventional "flip-over" latch to keep the top closed. The collection bag is connected to the diver. However, as the diver successfully fills his bag the weight of the catch requires the diver to add air to his or her buoyancy compensator ("BC") in order to offset the ballast created by the collected catch. This increase in air to the BC can create a dangerous situation by adding positive buoyancy to the diver's vest which can create an accelerated buoyant ascent if the ballasted collection bag becomes disconnected from the diver. This scenario may also arise given the fact that most divers remove the collection bag when adding additional material thus necessitating an easy to operate attachment mechanism.

Local, state and federal laws generally require at least one diver per group to carry or tow a dive flag attached to a line and reel for identification of diver location. This requirement presumably lessens the likelihood of a diver being struck by a passing boat, under the assumption that the boat operator will see the dive flag and stay clear of the area. One problem with conventional dive flags are that they are single dimension and can only be seen in certain directions. If a boater is traveling in the exact same or exact opposite direction as the wind, it is virtually impossible for the boater to see the flag and identify it as a diver down flag, until the boat is too close to the diver.

All divers in a group are typically meant to ascend under the flag buoy and utilize the line attached to the dive flag buoy as an ascent orientation guide. With multiple divers trying to ascend on a single line problems often occur. Furthermore, each diver individually towing a line is not a realistic option due to the likelihood of the lines becoming entangled with one another. Furthermore, towing of a dive flag and buoy is also uncomfortable and inhibits the diver's performance and collection abilities. As such, usually the diver who totes the line gets left out of any additional productive activities at depth.

Thus what is needed is a combination inflatable dive marker and collection bag which will allow the marker to be visible from all directions and allow the diver to bring the collected catch to the surface without attachment to the diver. It is therefore to the effective resolutions of the shortcomings in the prior art that the present invention is directed.

SUMMARY OF THE INVENTION

The present invention provides for a inflatable dive marker and collection bag which generally includes a dive flag/inflatable lift bladder and a vented mesh catch bag.

In the preferred embodiment, the closed buoyancy chamber or bladder is inflated with a "no lock" inflator device. An overpressure relief valve reduces the likelihood of overinflation resulting from human error or simple ascent expansion of the buoyancy chamber. The overpressure relief valve acts as a manual deflation device for adjustment at depth or deflation at the surface.

When collecting at depth the diver is able to proportionally offset the ballasting effect of his or her collecting activity by adjusting the amount of air in the bladder by the manual deflation device without altering his or her own personal BC device. Furthermore, a diver can also carry multiple collection bags and simply inflate and send to the surface for retrieval by the tender vessel above or for delayed retrieval later on by the diver him or herself. This feature addresses one of the most common concern of spearfisherman in aggressive shark areas by removing the game from the diver as soon as bagged without having to surface.

The design and inflated shape of the dive marker provides for far better visibility from all directions as opposed to conventional dive flags.

Preferably, the bottom half of the catch/collection bag is bell shaped. The bell shaped design provides for defined corners which lobster and other fish tend to travel to. Thus, when additional lobster, fish, conch, etc., are to be disposed in the bag, the already caught items are disposed down at the bottom of the bag by the corners, instead of the top of the bag where they might escape.

A zipper closure is provided at the bottom of the bag for easy removal of the contents, once the bag is brought unto the vessel or boat. At least a bottom portion of the catch/collection bag is preferably constructed from a vented mesh to provide for better water drainage when removing the bag out of the water and onto the boat.

The present invention allows a diver to carry his or her own marker that can be deployed at the end of a dive from depth and therefor allowing a personal ascent line without relying on another diver's location or timing. A d-ring is preferably provided at the bottom of the collection bag. The diver's individual line reel is preferably attached at one end to the d-ring by conventional means. Accordingly, when the diver wishes to resurface he or she inflates the lift bladder of the dive flag/marker through the "no lock" inflator, which causes the dive marker (top half of the collection bag) to rise to the surface and act as a cylindrical marker. Any catch or other items stored in the collection bag will also rise to the surface and are typically disposed in the bottom half of the collection bag. As one end of the line reel is attached to the d-ring which in turn is attached to the bottom of the collection bag, the diver is provided with his or her own ascent line. Thus, the diver does not have to wait in line with other diver's to travel up a single ascent line.

It is an object of the present invention to provide an inflatable dive marker and collection bag combination.

It is a further object of the present invention to provide a dive marker/flag which is more easily seen in the water as compared to conventional dive markers/flags.

It is yet another object of the present invention to provide an inflatable dive marker and collection bag which can be sent to the surface without the diver.

It is still another object of the present invention to provide an inflatable dive marker and collection bag which can serve as an individual ascent line for a diver.

In accordance with these and other objects which will become apparent hereinafter, the instant invention will now be described with particular reference to the accompanying drawings.

DESCRIPTION OF THE PREFERRED EMBODIMENTS

Figure 1:
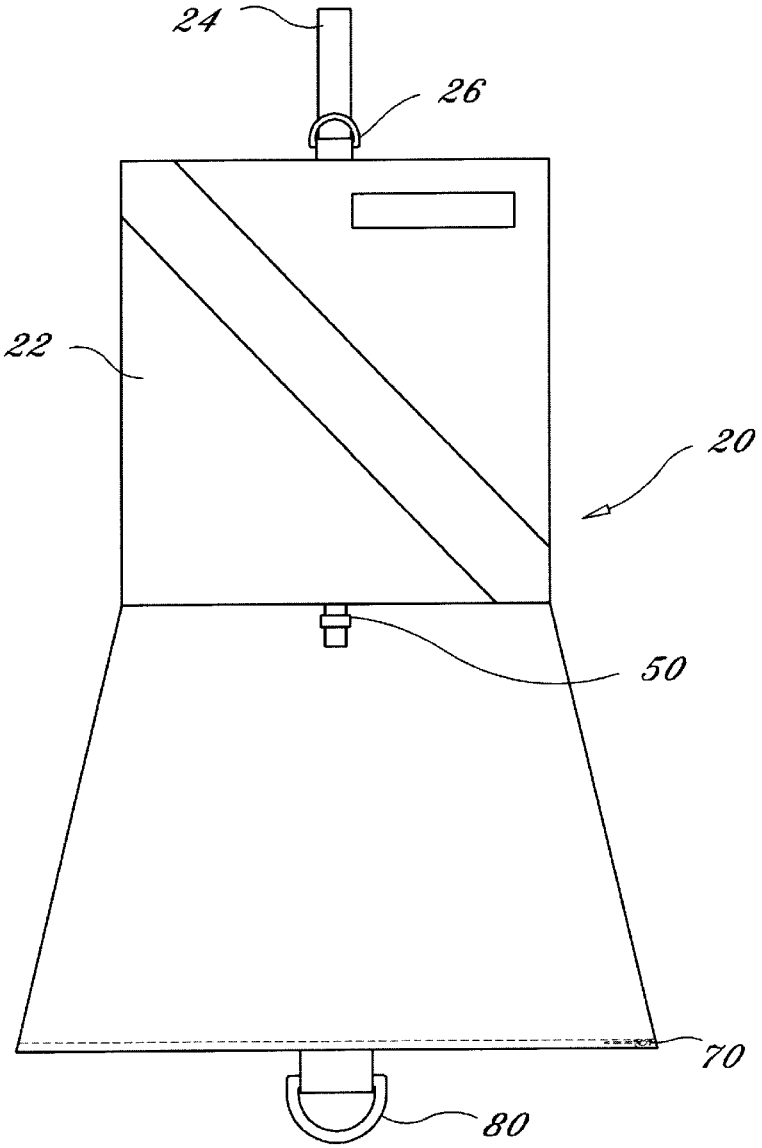
FIG. 1 is a front view of the inflatable dive marker and collection bag in accordance with the present invention.
Figure 2:
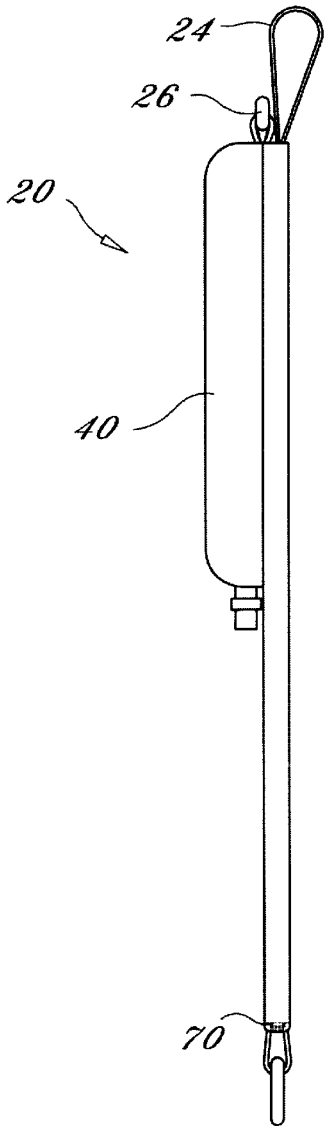
FIG. 2 is a side view of the inflatable dive marker and collection bag shown in FIG. 1.

As seen in the drawings an inflatable dive marker and collection bag is shown with the collection bag generally designated as reference numeral 20 and the conventional dive marking symbol shown as indicia 22 on a top portion of collection bag 20. Collection bag 20 extends from the top end to a bottom end. The top end is provided with a hook and loop fastening members on both sides of the inside surface of collection bag 20 near the top end. The hook and loop fastening member are provided for keeping the top end closed.

A handle 24, preferably in the form of strap forming a loop, is provided to release the hook and loop fastening attachment to allow access to the collection bag for insertion of lobster, conch, fish, shells, treasure, etc. In use, the collection bag is attached to the diver by conventional means, preferably connected to d-ring 26 disposed at the top end of collection bag 20. The diver grabs handle 24 with one hand to open the top end of collection bag and inserts or drops the collected item (i.e. lobster, conch, etc.) into the collection bag with the other hand. Once the item has been inserted, the diver lets go of handle 24. A spring-like member (not shown) is also provided at the top end of collection bag 20, to quickly cause the sides of collection bag 20 at the top end, to quickly come together and remain attached by the hook and loop fastening members. Thus, the top end is preferably spring loaded and remains securely closed, until the diver grabs handle 24 to again break the hook and loop fastening attachment as described above.

An inflatable bladder member 40 is provided on one side of the top portion of collection bag 20. In the preferred embodiment a "no lock" inflator 50 is provided for filling bladder 40 with the desired amount of gas. In this embodiment, bladder 40 is a closed buoyancy chamber. The inflation of bladder 40 to an appropriate level will cause the dive marker/collection bag 20 to ascend to the surface. To inflate bladder 40, the diver manually maintains the auxiliary air hose (not shown) from his or her buoyancy compensator (not shown) onto inflater 50, to allow gas to travel through a one-way valve in inflator 50 into bladder 40. For safety purposes, no actual connection is made between inflator 50 and the auxiliary air hose, and if the diver releases his or her hands from auxiliary air hose, the air hose will become detached from inflator 50.

Once the air hose is detached, air does not escape from bladder 40 in view of the one-way valve within inflator 50. However, to prevent too much air or gas being pumped into bladder and possibly damaging bladder 50, a conventional overpressure relief valve (not shown) can be associated with bladder 50. Overpressure relief valve can be set to a certain level (i.e. 2 p.s.i.). Thus, any amount of air or gas, within the bladder, over the set level will be discharged through overpressure relief valve.

The overpressure relief valve reduces the likelihood of overinflation resulting from human error or simple ascent expansion of the buoyancy chamber. The overpressure relief valve also acts as a manual deflation device for adjustment at depth or deflation at the surface.

Though not preferred, in lieu of inflator 50 a small opening can be provided at the bottom of bladder 40, where inflator is normally disposed. The opening can be closed by hook and loop fastening means. A small strap handle, which can have a d-ring attached at an outer end, is provided to release the close attachment of the hook and loop fastening means in order to provide access within bladder 40. To inflate bladder 40, the diver takes his or her regulator and positions the regulator at the small opening to direct air or gas into bladder. Due to the position of bladder 40 and gravity, the directed air will rise to the top of bladder 40, causing the dive marker/collection bag 20 to rise to the surface, with the dive marker portion of collection bag 20 protruding upwards out of the water for a certain amount of time.

As discussed above, while the diver is traveling underwater in search of lobster, conch, treasure, etc. collection bag 20 can be removably attached to the diver by conventional means associated with d-ring 26. However, before collection bag 20 is attached to the diver, air or gas should be slowly added to or remove from bladder 40, as described above, in order to ensure collection bag 20 is neutrally buoyant. Thus, where bag 20 is neutral, attaching such bag to the diver will not cause the diver to unintentionally ascent, which could cause injury to the diver. Furthermore, after each time an item or items (i.e. lobster) are disposed within bag 20, bag 20 should be detached from the diver and checked to ensure that bag 20 is neutrally buoyant. The addition of the collected items within bag 20 can create additional ballast (weight) which may require additional air or gas be directed into bladder 40 to offset the additional ballast, in order to keep bag 20 neutral.

Thus, when collecting at depth the diver is able to proportionally offset the ballasting effect of his or her collecting activity by adjusting the amount of air in bladder 40 by the manual deflation device (overpressure relief valve) without altering his or her own personal BC device.

Preferably, the bottom half or portion of collection bag 20 is bell shaped. The bell shaped design provides for defined corners which lobster and other fish tend to travel to. Thus, when additional lobster, fish, conch, etc., are to be disposed in collection bag 20, the already caught items typically will be disposed down at the bottom of the bag by the corners, instead of the top of bag 20 where they might escape.

A zipper closure 70 is provided at the bottom of collection bag 20 for easy removal of the contents, once bag 20 is brought unto the vessel or boat. At least a bottom end portion of collection bag 20, adjacent zipper 70, can be preferably constructed from a vented mesh to provide for better water drainage when removing the bag out of the water and onto the boat. Thus, the total weight of bag 20 and the collected items is reduced for lifting purposes.

The present invention allows a diver to carry his or her own marker that can be deployed at the end of a dive from depth and also allowing for a personal ascent line without relying on another diver's location or timing. A d-ring 80 is preferably provided at the bottom of collection bag 20. The diver's individual line reel is preferably attached at one end to d-ring 80 by conventional means. Accordingly, when the diver wishes to resurface he or she inflates lift bladder 40, as described above, which causes the dive marker/collection bag 20 to rise to the surface and with the top half or portion of bag 20 protruding upwards out of the water and acting as a cylindrical marker. The design and inflated shape of the top portion of collection bag 20, which is provided with an outer surface having indicia representing a conventional dive marker, provides for far better visibility from all directions as opposed to conventional single dimension dive flags.

Any catch or other items stored in the collection bag will also rise to the surface and are preferably disposed within the bottom half or portion of collection bag 20. As one end of the line reel is attached to d-ring 80 which in turn is attached to the bottom of collection bag 20, the diver is provided with his or her own ascent line. Thus, the diver does not have to wait in line with other diver's to travel up a single ascent line.

The diver can also carry multiple collection bags 20 and simply inflate, as needed, and send to the surface for retrieval by the tender vessel above or for delayed retrieval later on by the diver. This feature addresses one of the most common concern of spearfisherman in aggressive shark areas by removing the game from the diver as soon as bagged without the diver having to surface.

When bladder 40 is deflated, collection bag 20 can be easily folded and stored in such position until needed. To maintain bag 20 is such folded position, a first hook and loop fastening strip can be provided on a portion of the outer surface of collection bag 20. The first hook and loop fastening strip mates with a second hook and loop fastening strip disposed on a portion of handle 24.

It should be understood that other conventional connectors can be used or substituted for the d-rings described above and are considered within the scope of the invention. Furthermore, though zipper 70 is preferred, other conventional opening/closing devices can be used or substituted for zipper 70, such as snaps, hook and loop fastening means, buttons, etc.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A collection bag, comprising:

a body member having an upper portion and a lower portion, said lower portion defining a collection area, said lower portion having a lower end;

a bladder member provided on an upper portion of said body member;

means for inflating said bladder; and means for opening and closing the lower end of said lower portion;

wherein said means for opening and closing is a zipper closure disposed at said lower end of said lower portion.

2. The collection bag of claim 1 wherein said upper portion having an outer surface, at least a portion of said outer surface containing dive flag indicia.

3. The collection bag of claim 1 wherein said lower portion including a first side and a second side attached to each other and wherein said lower portion having a lower end which is provided with at least one extended corner.

4. The collection bag of claim 2 wherein the lower end of said lower portion is provided with extended corners to form a substantially bell shaped collection area.

5. The collection bag of claim 1 wherein said means for inflating is a valve in communication with said bladder.

6. The collection bag of claim 1 further including a connector member for attaching said body member to a portion of a diver's equipment.

7. The collection bag of claim 1 wherein said bladder having a closeable opening and means for opening and closing said bladder member at said closeable opening to allow air or gas to be inserted within said bladder member by said means for inflating.

8. The collection bag of claim 7 wherein said means for opening and closing is a pair of hook and loop fastening members disposed at said closeable opening of said bladder member.

9. The collection bag of claim 1 further including a connector attached to said body member, said connector adapted for attachment to a diver's line reel.

10. The collection bag of claim 9 wherein said connector is a D-ring attached at a bottom end of said body member.

11. The collection bag of claim 1 further including a strap handle attached to the upper portion of said body member.

* * * * *